US006315392B1

(12) United States Patent
Kinas et al.

(10) Patent No.: US 6,315,392 B1
(45) Date of Patent: Nov. 13, 2001

(54) FASTER UNDER/OVER PRINTING BY AN INKJET PRINTER

(75) Inventors: Erick Kinas, Camas, WA (US); Eric L. Ahlvin, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/502,189

(22) Filed: Feb. 10, 2000

(51) Int. Cl.[7] ..... B41J 2/21
(52) U.S. Cl. ..... 347/43; 347/15
(58) Field of Search ..... 347/12, 15, 40, 347/41, 43, 6; 358/502, 517

(56) References Cited

U.S. PATENT DOCUMENTS

| | | | | |
|---|---|---|---|---|
| 4,952,942 | * | 8/1990 | Kanome et al. | 347/43 |
| 5,568,169 | | 10/1996 | Dudek et al. | 347/43 |
| 5,933,164 | * | 8/1999 | Sato et al. | 347/43 |
| 6,132,021 | * | 10/2000 | Smith et al. | 347/6 |
| 6,139,127 | * | 10/2000 | Kato et al. | 347/15 |
| 6,158,834 | * | 12/2000 | Kato et al. | 347/43 |

FOREIGN PATENT DOCUMENTS

| | | |
|---|---|---|
| 1038688 | 9/2000 | (EP) . |
| 2293352 | 3/1996 | (GB) . |

* cited by examiner

*Primary Examiner*—Thinh Nguyen
*Assistant Examiner*—Lamson D. Nguyen

(57) ABSTRACT

A printer that includes a carriage, a first printhead mounted in the carriage, a second printhead printing black ink mounted in the carriage, and a third printhead mounted in the carriage, where the second printhead is between the first printhead and the third printhead. The printer further includes a print zone having left and right boundaries where text or another image is to be printed by black ink. The carriage scans such that the second printhead does not go beyond the left and right boundaries of the print zone. The leading one of the first or third printheads underprints the black ink. A trailing one of the first or third printheads overprints the black ink. Using this technique, the scanning distance is reduced by at least the width of two printheads, resulting in a 20% improvement in printing speed in one embodiment. Techniques for reducing hue shifts between adjacent print swaths are described.

20 Claims, 3 Drawing Sheets

FASTER UNDER/OVER PRINTING BY AN INKJET PRINTER

FIELD OF THE INVENTION

The present invention relates to printers and, in particular, to a technique for increasing the speed of printing an image on a medium.

BACKGROUND OF THE INVENTION

Conventional printers are capable of printing in several different modes. The modes represent tradeoffs between print speed and print quality. For example, a printer may have a "best" mode which prints a high quality image at a relatively slow speed, a "normal" mode which prints a medium quality image at a relatively medium speed, and an "economy" mode which prints a low quality image, typically text, at a relatively fast speed.

One way of increasing print speed in color printers is to minimize the distance the carriage in the printer must travel. The carriage of a color printer typically holds several printheads (e.g., cyan, magenta, yellow, and black) and scans across a medium while depositing drops of ink from the printheads along the way. After the carriage completes one or more scans, the medium is shifted, and the carriage then begins another scan. This process is repeated until a desired image is formed on the medium. Since the carriage must scan this distance numerous times before the desired image is printed on the medium, a significant time savings could be achieved if the distance the carriage had to travel to complete a scan could be shortened.

Another way of increasing effective print speed in color printers is to underprint and overprint the black ink. As used herein, underprinting refers to depositing one or more drops of color ink (or a fixer fluid) on dot locations that will subsequently have one or more drops of black ink deposited thereon, and overprinting refers to depositing one or more drops of color ink (or a fixer fluid) on dot locations that have previously received one or more drops of black ink.

Underprinting and/or overprinting increases print speed because, with certain types of ink, black ink dries more quickly when it comes in contact with the color ink. This is due to the different chemistries of black ink and color inks. Black inks are often pigment based where color inks are often dye based. Pigment based inks dry slower than dye based inks. Since black ink dries relatively slowly, and since the ink must be dry before it is touched or has another sheet of paper dropped on top of it, the black ink drying time frequently becomes the bottleneck for print speed. Underprinting with a dye-based ink effectively wets the medium so that the black pigment vehicle is more quickly absorbed by the medium and dries quickly. Overprinting offsets any color shift by the underprinting.

Additionally, a chemical reaction may take place between the black ink and certain types of underprinted or overprinted ink (or other fluid) to speed up the drying time of the black ink. This also prevents the black ink from bleeding into adjacent color image portions. Accordingly, underprinting and/or overprinting increases print speed by decreasing the time it takes black ink to dry.

Another advantage of underprinting and overprinting is that the optical density (i.e., blackness) of the black printed image is increased if underprinting and/or overprinting is used.

A disadvantage of underprinting and overprinting is that the carriage which holds the cyan (C), black (K), magenta (M), and yellow (Y) printheads must travel a longer distance in order for the color inks (typically cyan and magenta) to underprint and overprint all of the black dot locations. This is especially disadvantageous when print speed is at a premium, for example when printing in the previously described "economy" mode.

Accordingly, what is needed is a technique that allows for underprinting and overprinting while minimizing the distance the carriage must travel when scanning across a medium.

SUMMARY

The present invention provides a method and an apparatus that allows for underprinting and overprinting while minimizing the distance the carriage must travel when scanning across a medium.

In one embodiment of the invention, a printer includes a carriage, a first printhead (e.g., cyan) mounted in the carriage, a second printhead containing black ink mounted in the carriage adjacent to the first printhead, and a third printhead (e.g., magenta) mounted in the carriage adjacent to the second printhead. The printer has a print zone, where black ink may be printed, having a left boundary and a right boundary. The carriage scans across the print zone such that the second printhead does not extend beyond the left or right boundary of the print zone, while the first and third printheads provide underprinting and/or overprinting of the black ink, depending on the leading and trailing printhead during a scan.

In the most straight-forward approach for underprinting, the leading printhead, rather than the black ink printhead, is positioned by the carriage at the edges of the print zone. The present technique modifies this straight-forward approach, as described above and, in one embodiment, reduces carriage travel by 1.5 inches during each scan to speed up printing by about 20%.

In one embodiment of the invention, the amount of ink deposited by the first printhead and third printhead for underprinting and overprinting is coordinated to minimize hue shift.

DETAILED DESCRIPTION OF THE EMBODIMENTS

Figure 1:
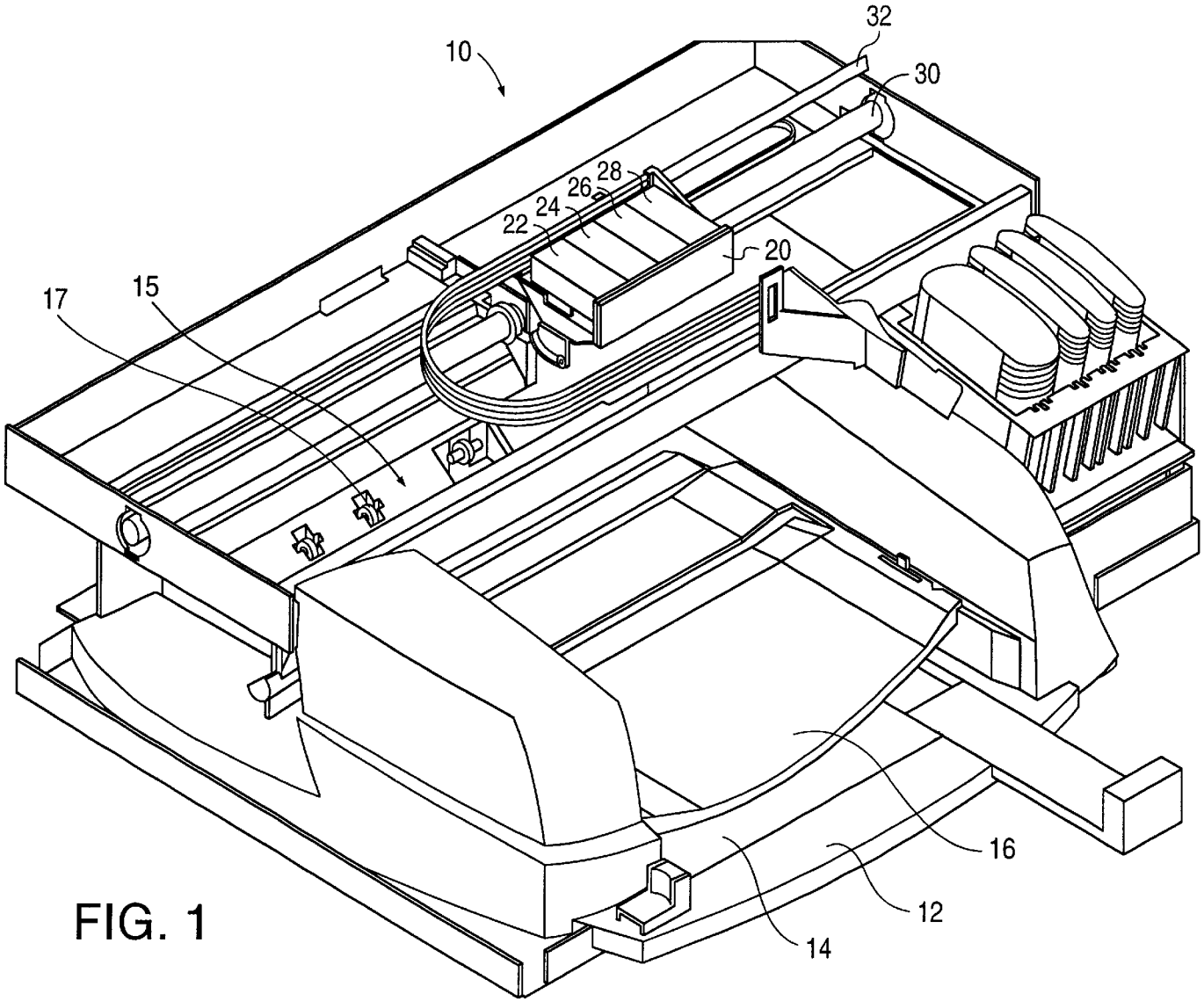
FIG. 1 illustrates one of many examples of an inkjet printer that incorporates the present invention.

FIG. 1 illustrates one embodiment of an inkjet printer 10 that carries out the invention. It is to be understood that numerous other designs of inkjet printers may also be used while carrying out this invention.

Inkjet printer 10 includes an input tray 12 containing a medium 14 (e.g., paper) which is forwarded through a print zone 15 using rollers 17. The medium 14 is then forwarded to an output tray 16. A moveable carriage 20 holds a cyan printhead 22, a black printhead 24, a magenta printhead 26, and a yellow printhead 28. In this embodiment, the carriage 20 is moved along a scan axis by a conventional belt and pulley system and slides along a slide rod 30.

Printing signals from a conventional external computer (e.g., a personal computer) are processed by printer 10 to generate a bitmap of the dots to be printed. Each dot location may contain one or more drops of ink from one or more printheads. The bitmap is then converted into synchronized firing signals for the printheads. The position of the carriage 20 as it traverses back and forth along the scan axis while printing is determined from an optical encoder strip 32, detected by a photoelectric element on carriage 20, to cause the various ink ejection elements on each printhead to be selectively fired at the appropriate time during a carriage scan. After one or more scans, the medium 14 is shifted in a direction toward the output tray 16, and the carriage 20 resumes scanning. This process continues until the desired image has been printed on the medium.

Figure 2:
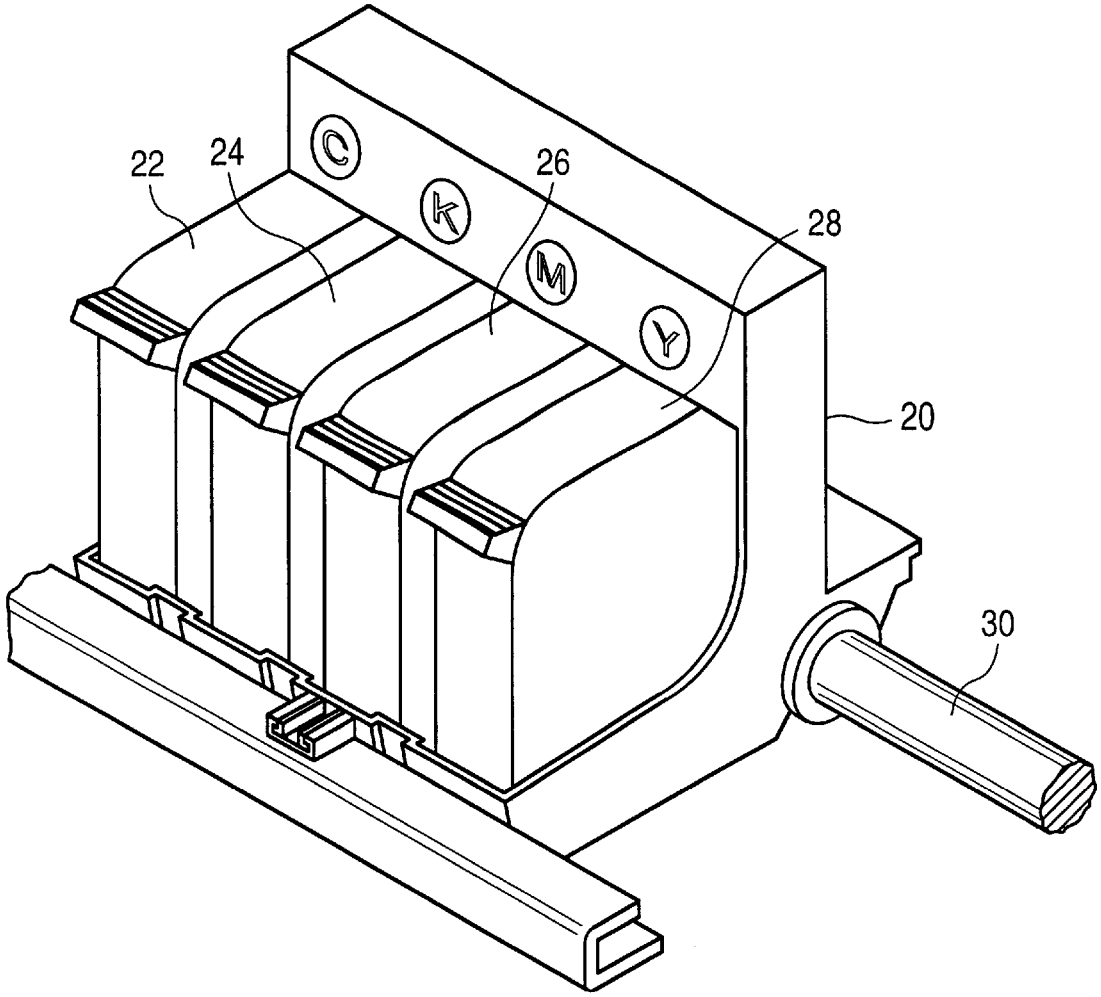
FIG. 2 illustrates the scanning carriage in the printer of FIG. 1 and one possible order of print cartridges in the carriage.

FIG. 2 illustrates one example of carriage 20 with printheads 22, 24, 26, and 28 installed. In this example, the printheads are arranged in the order of CKMY, as viewed from the front of printer 10. Other orders and colors may also be used. In another embodiment, clear fixer fluid printheads are also installed in carriage 20 for underprinting and overprinting.

In one embodiment, the distance between the centers of each printhead is approximately 0.745 inches. In this embodiment, the distance is the same between the cyan and black printhead, the black and magenta printhead, and the magenta and yellow printhead. In other embodiments, the distance can be different between adjacent printheads.

Figure 3:
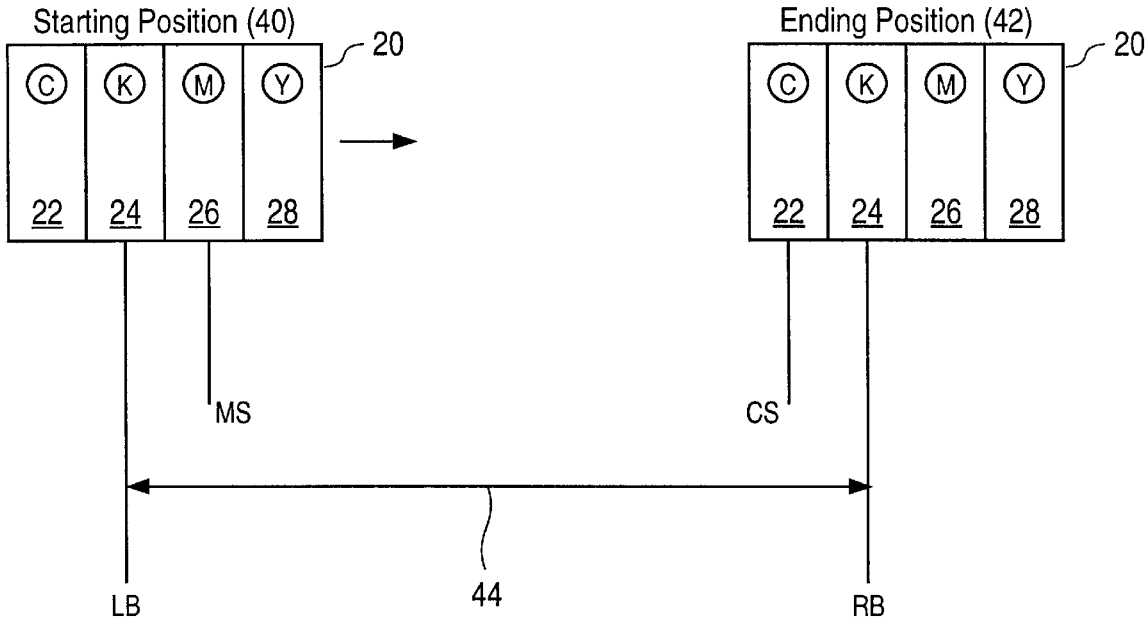
FIG. 3 illustrates the scanning carriage of FIG. 2 in a starting position and in an ending position according to the present invention.

FIG. 3 illustrates the carriage 20 of FIG. 2 in a starting position 40 and in an ending position 42 (assuming a left to right scan) according to one example of the present invention. FIG. 3 also illustrates a print zone 44 having a left boundary LB and a right boundary RB. The print zone 44 (actually underneath the printheads) represents the area where drops of ink can be deposited onto the medium by the printheads. Areas to the left of the left boundary LB and areas to the right of the right boundary RB are outside of the print zone 44 and therefore will not be printed upon. As an example, if a page of text were to be printed, the left boundary LB would represent the left margin of the paper, and the right boundary RB would represent the right margin of the paper.

A scan begins when the black printhead 24 in the carriage 20 is aligned with the left boundary LB. As the carriage 20 moves toward the right boundary RB, the printheads deposit drops of ink in the print zone 44. The carriage continues to move toward the right boundary RB until the black printhead 24 is aligned with the right boundary RB. After the carriage stops, the medium present in the print zone may be shifted through the print zone by the rollers 17 (FIG. 1), or the medium may remain in the same position for multiple scans. The carriage then scans in the reverse direction while the printheads eject droplets of ink.

Underprinting

In one embodiment, when the carriage 20 scans from left to right, the magenta printhead 26 underprints the dot locations where black ink will subsequently be deposited by the trailing black printhead 24. The scan begins with the black printhead 24 in the carriage 20 aligned with the left boundary LB. The magenta printhead 26 begins underprinting (as required) at the position labeled magenta start MS at the time the scan begins. The magenta printhead 26 continues to underprint dot locations that will subsequently receive one or more drops of black ink as the carriage 20 moves toward the right boundary RB. As the carriage approaches the right boundary RB, the magenta printhead 26 will continue to underprint until the magenta printhead 26 reaches the right boundary RB. At this point, the magenta printhead 26 will not deposit any more drops of ink, but the magenta printhead 26 will continue to move beyond the right boundary RB until the black printhead 24 is aligned with the right boundary RB. When the black printhead 24 is aligned with the right boundary RB, the carriage 20 will stop at ending position 42, then reverse direction.

After the carriage stops, the medium present in the print zone may be shifted by the rollers 17 or the medium may remain in the same position for one or more additional scans. Note that in this embodiment, the area of the print zone 44 between the left boundary LB and magenta start MS is not underprinted since the carriage 20 does not move far enough to the left such that the magenta printhead 26 is aligned with the left boundary LB.

When printing from right to left, the cyan printhead 22 is used for underprinting, and the operation is essentially a mirror image of the magenta underprinting.

Overprinting

In one embodiment, when the carriage 20 scans from left to right, the cyan printhead 22 overprints the dot locations where black ink has previously been deposited by the black printhead 24 during the same scan. Typically, the same dot locations will have been underprinted by the leading printhead. The scan begins with the black printhead 24 in the carriage 20 aligned with the left boundary LB. The cyan printhead 22 begins overprinting (as required) a short time after the scan begins, when the cyan printhead 22 is aligned with the left boundary LB. The cyan printhead 22 continues to overprint dot locations that have previously received one or more drops of black ink as the carriage 20 moves toward the right boundary RB. As the carriage approaches the right boundary RB, the cyan printhead 22 will continue to overprint until the black printhead 24 reaches the right boundary RB. At this point, the carriage 20 has reached ending position 42.

After the carriage stops, the medium present in the print zone may be shifted by the rollers 17 or the medium may remain in the same position for one or more additional scans. Note that in this embodiment, the area of the print zone 44 between the cyan stop CS and the right boundary RB is not overprinted since the carriage 20 does not move far enough to the right such that the cyan printhead 22 is aligned with the right boundary.

When the carriage 20 scans from right to left, the magenta printhead 26 overprints, and the operation is essentially a mirror image of the cyan overprinting.

In the above embodiments, the area of the print zone 44 between the left boundary LB and magenta start MS (for magenta underprinting) and the area of the print zone 44 between the cyan stop CS and right boundary RB (for cyan underprinting) were not underprinted. Similarly, the area of the print zone 44 between the right boundary RB and the cyan stop CS (for cyan overprinting) and the area between the magenta start MS and left boundary LB (for magenta overprinting) were not overprinted.

Overprinting and Underprinting in Same Scan

Overprinting is typically used to offset hue shifts caused by the magenta and cyan underprinting. Further, with certain types of inks, overprinting, without underprinting, is used to "fix" the black ink to avoid smudging.

In one embodiment, when the carriage 20 moves from left to right, the leading magenta printhead 26 underprints the dot locations where black ink will subsequently be deposited by the black printhead 24, and the trailing cyan printhead 22 overprints the dot locations where black ink has previously been deposited by the black printhead 24. This combined underprinting and overprinting during the same scan uses the underprinting and overprinting techniques previously described. In left to right printing, the area between the left boundary LB and magenta start MS will not be underprinted. Similarly, the area between cyan stop CS and the right boundary RB will not be overprinted.

After the carriage stops, the medium present in the print zone may be shifted by the rollers 17 or the medium may remain in the same position for one or more additional scans.

When the carriage 20 reverses and scans from right to left, the magenta printhead 26 will overprint while the cyan printhead 22 underprints. In right to left printing, the area between the right boundary RB and cyan stop CS will not be underprinted, and the area between magenta start MS and the left boundary LB will not be overprinted.

Hue Shift Minimization Using Underprinting And Overprinting

When underprinting and overprinting during the same scan, it is important that dot locations that will be both underprinted and overprinted receive the proper amounts (e.g., equal amounts) of magenta ink and cyan ink to prevent hue shift problems between adjacent horizontal print swaths due to the under/over inks used for left to right printing in a swath being different from the under/over inks used for right to left printing in an adjacent swath. Thus, it is advantageous to deposit the magenta and cyan ink in a way that minimizes this problem.

In one embodiment, assuming a left to right carriage 20 scan, this problem can be minimized by ramping down the amount of underprinting magenta ink drops deposited after the cyan stop CS position. Similarly, assuming a right to left carriage 20 scan, the hue shift problem can be minimized by ramping down the amount of overprinting cyan ink drops deposited after the magenta start MS position. This same technique can be used when underprinting cyan or overprinting magenta.

Ideally, the optimum amounts of underprinting and overprinting inks are deposited between the MS and CS positions to avoid hue shifts of adjacent print swaths between the MS and CS positions. The amounts deposited may be different for the two scan directions and must be determined empirically.

Those skilled in the art will recognize that there are many different techniques of underprinting and overprinting that can be implemented to minimize the hue shift problem, especially toward the left and right boundaries. One other technique is to ramp the underprinting and overprinting inks across the entire print zone. For example, for a left to right carriage 20 scan, underprinting magenta will ramp up from 0% to 100% across the print zone while overprinting cyan will ramp down from 100% to 0% across the print zone. For right to left printing, underprinting cyan will ramp up from 0% to 100% while overprinting magenta will ramp down from 100% to 0% across the print zone. Thus, hue shifts between adjacent swaths on the medium will not be detectable.

Figure 4:
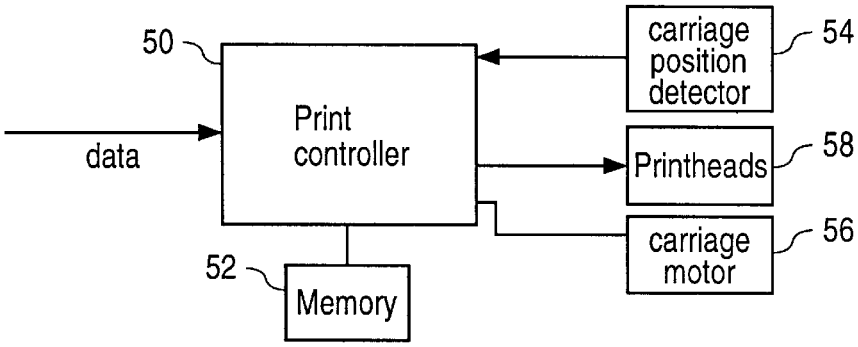
FIG. 4 illustrates a print controller for controlling the carriage scanning and printheads.

FIG. 4 illustrates the functional portion of the printer 10 of FIG. 1 that controls the carriage scanning position and the ejection of ink from the printheads. The hardware used to implement the present invention is already found in conventional printers. The present invention is implemented by firmware or software in a memory or other type of controller. Those skilled in the art of developing routines for printers will readily understand how to implement the present invention.

In FIG. 4, printing data is applied to a print controller 50. A memory 52, or other conventional means such as programmable logic, provides instructions to the controller 50. The controller 50 receives position information from the carriage position detector 54 and controls the carriage motor 56 to position the carriage. The controller 50 synchronizes the energization signals to the various printheads 58 with the carriage position to print droplets in predetermined positions on the medium.

Illustration of the Advantages of the Present Invention

As described above, in accordance with the present invention, the carriage 20 moves the black printhead 24 back and forth between the left boundary LB and the right boundary RB, defining the maximum print zone for black ink, typically for printing text. If the distance between LB and RB is 6.5 inches (assuming a medium 8.5 inches wide with 1.0 inch margins on each side), the carriage 20 will travel a total distance of 6.5 inches in a scan for printing black text across a page using the present invention.

The most straight-forward approach for underprinting would have the carriage scan such that the leading (underprinting) printhead begins its scan starting at the left and right boundaries of the print zone. If the distance between the centers of adjacent printheads is 0.75 inches, the straight-forward approach requires a carriage scan of 8 inches. The present invention reduces the required scan of the carriage by 1.5 inches, which is a reduction by almost 20% of the carriage scan using the straight-forward approach. This equates to a 20% improvement in printing speed.

The present invention is particularly applicable to printing black text across a page and especially applicable when printing in a maximum speed, reduced quality mode for drafts.

The inventions applies to any order of printheads. In one embodiment, the under and overprinting printheads print fixer fluid rather than color ink.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A printer comprising:

a carriage;

a first printhead mounted in the carriage, said first printhead underprinting black ink in a first carriage scan direction;

a second printhead printing black ink mounted in the carriage;

a third printhead mounted in the carriage, said third printhead underprinting black ink in a second carriage scan direction, the third printhead located on a first side of the second printhead, and the first printhead located on a second side of said second printhead;

a print zone in which ink from the first, second and third printheads is deposited as the carriage scans across the print zone, the print zone having a left boundary and a right boundary, ink from the first, second and third printheads being deposited within the left and right boundaries of the print zone; and a print controller coupled to the carriage, the print controller restricting scanning of the carriage across the print zone such that said second printhead does not go beyond the left boundary and the right boundary of the print zone.

2. The printer of claim 1 wherein the third printhead is controlled to overprint the black ink deposited by the second printhead in said first carriage scan direction.

3. The printer of claim 1 wherein the first printhead is controlled to overprint the black ink deposited by the second printhead in said second carriage scan direction.

4. The printer of claim 3 wherein the amounts of ink deposited by the first printhead and third printhead are coordinated to reduce hue shift between adjacent print swaths.

5. The printer of claim 1 wherein the first printhead deposits drops of color ink, the second printhead deposits drops of black ink, and the third printhead deposits drops of color ink.

6. The printer of claim 1 further comprising a fourth printhead mounted in the carriage, wherein the fourth printhead deposits drops of color ink, and wherein the fourth printhead is located adjacent to the third printhead.

7. The printer of claim 1 wherein the first printhead deposits cyan ink, the second printhead deposits black ink, and the third printhead deposits magenta ink.

8. The printer of claim 1 wherein the amount of ink deposited by the third printhead for underprinting said black ink increases as the carriage moves in said second carriage scan direction, and wherein the amount of ink deposited by the first printhead for underprinting said black ink increases as the carriage moves in said first carriage scan direction to reduce hue shifts in adjacent print swaths.

9. The printer of claim 1 wherein said second printhead does not go beyond the left boundary and the right boundary during a high speed, reduced quality print mode of said printer.

10. The printer of claim 1 wherein said second printhead is controlled to print text.

11. A method for printing an image on a medium comprising:

scanning a carriage, containing a first printhead, a second printhead printing black ink located adjacent to the first printhead, and a third printhead located adjacent to the second printhead, across a print zone, said print zone having a left boundary and a right boundary, ink from the first, second and third printheads being deposited within the left and right boundaries of the print zone;

controlling said first printhead for underprinting black ink in a first carriage scan direction;

controlling said third printhead for underprinting black ink in a second carriage scan direction;

stopping the carriage in the first carriage scan direction when the second printhead reaches the left boundary of the print zone; and stopping the carriage in the second carriage scan direction when the second printhead reaches the right boundary of the print zone.

12. The method of claim 11 further comprising depositing one or more drops of ink on dot locations that have previously received one or more drops of ink from the second printhead.

13. The method of claim 11 wherein the first printhead deposits drops of color ink, the second printhead deposits drops of black ink, and the third printhead deposits drops of color ink.

14. The method of claim 13 further comprising controlling a fourth printhead mounted in the carriage, wherein the fourth printhead deposits drops of color ink, and wherein the fourth printhead is located adjacent to the third printhead on a side opposite of the second printhead.

15. The method of claim 13 wherein the first printhead deposits cyan ink, the second printhead deposits black ink, and the third printhead deposits magenta ink.

16. The method of claim 11 further comprising:

controlling the third printhead to overprint the black ink deposited in said first carriage scan direction; and controlling the first printhead to overprint the black ink deposited in said second carriage scan direction.

17. The method of claim 16 further comprising controlling the amount of ink deposited by the first printhead and third printhead for overprinting and underprinting to minimize hue shifts between adjacent print swaths.

18. The method of claim 17 further comprising:

decreasing the amount of ink deposited by the third printhead during overprinting by the third printhead as the carriage moves in said second scan direction; and increasing the amount of ink deposited by the first printhead during underprinting by the first printhead as the carriage moves in said second scan direction.

19. The method of claim 17 further comprising:

increasing the amount of ink deposited by the third printhead during underprinting by the third printhead as the carriage moves in said first scan direction; and decreasing the amount of ink deposited by the first printhead during overprinting by the first printhead as the carriage moves in said first scan direction.

20. A method for printing an image on a medium comprising:

scanning a carriage, containing a first printhead, a second printhead printing black ink located adjacent to the first printhead, and a third printhead located adjacent to the second printhead, across a print zone, said print zone having a left boundary and a right boundary, ink from the first, second and third printheads being deposited within the left and right boundaries of the print zone;

controlling said first printhead for overprinting black ink in a first carriage scan direction;

controlling said third printhead for overprinting black ink in a second carriage scan direction;

stopping the carriage in the first carriage scan direction when the second printhead reaches the right boundary of the print zone; and stopping the carriage in the second carriage scan direction when the second printhead reaches the left boundary of the print zone.

* * * * *